US009630431B2

(12) United States Patent
Onodera

(10) Patent No.: US 9,630,431 B2
(45) Date of Patent: Apr. 25, 2017

(54) PRINTER

(71) Applicant: SATO HOLDINGS KABUSHIKI KAISHA, Tokyo (JP)

(72) Inventor: Hitoshi Onodera, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/108,164

(22) PCT Filed: Dec. 25, 2014

(86) PCT No.: PCT/JP2014/084330
§ 371 (c)(1),
(2) Date: Jun. 24, 2016

(87) PCT Pub. No.: WO2015/099052
PCT Pub. Date: Jul. 2, 2015

(65) Prior Publication Data

US 2016/0325568 A1 Nov. 10, 2016

(30) Foreign Application Priority Data

Dec. 26, 2013 (JP) ..... 2013-268259

(51) Int. Cl.
*B41J 2/32* (2006.01)
*B41J 25/00* (2006.01)
(Continued)

(52) U.S. Cl.
CPC ..... *B41J 25/001* (2013.01); *B41J 2/32* (2013.01); *B41J 2/325* (2013.01); *B41J 11/04* (2013.01); *B41J 15/042* (2013.01)

(58) Field of Classification Search
CPC .... B41J 13/0009; B41J 11/0095; B41J 11/42; B41J 3/4075; B41J 15/042; B41J 11/0075; B41J 13/02; B41J 13/03
See application file for complete search history.

(56) References Cited

U.S. PATENT DOCUMENTS 8,585,305 B2 * 11/2013 Naito ..... B41J 29/02 347/197
8,692,857 B2 * 4/2014 Jimbo ..... B41J 11/0025 347/197
(Continued)

FOREIGN PATENT DOCUMENTS

JP 05-229223 A 9/1993
JP 5-93842 U 12/1993
(Continued)

*Primary Examiner* — Lamson Nguyen
(74) *Attorney, Agent, or Firm* — Foley & Lardner LLP

(57) ABSTRACT

A configuration includes a paper sheet supply unit that supplies a continuous paper, a supporting stand that includes a platen roller feeding the continuous paper supplied from the paper sheet supply unit to a front along a paper passing route, a printing unit that includes a bracket to which a thermal head is mounted, prints on the continuous paper in a position opposing to the platen roller, and is disposed openable/closable in a vertical direction with respect to the supporting stand by the swinging bracket, and a support plate that swings in conjunction with opening and closing of the printing unit to displace a lower portion side of the thermal head to a front in an open position of the printing unit.

4 Claims, 9 Drawing Sheets

(51) Int. Cl.

| | |
|---|---|
| ***B41J 2/325*** | (2006.01) |
| ***B41J 15/04*** | (2006.01) |
| ***B41J 11/04*** | (2006.01) |

(56) References Cited

U.S. PATENT DOCUMENTS

| | | | | |
|---|---|---|---|---|
| 8,851,663 | B2 * | 10/2014 | Maeda | B41J 11/30 347/101 |
| 2011/0058878 | A1 | 3/2011 | Maeda et al. | |

FOREIGN PATENT DOCUMENTS

| | | | |
|---|---|---|---|
| JP | 06-155856 | A | 6/1994 |
| JP | 11-020214 | A | 1/1999 |
| JP | 2000-225751 | A | 8/2000 |
| JP | 2002-200815 | A | 7/2002 |
| JP | 2007-301869 | A | 11/2007 |
| JP | 2009-286000 | A | 12/2009 |

* cited by examiner

PRINTER

TECHNICAL FIELD

The present invention relates a printer, for example, a printer having a printing function that prints desired information, such as a character, a sign, a diagram, a barcode, or similar information, on a print medium such as a label or a similar print medium.

BACKGROUND ART

A label printer is a printer having a function that, for example, prints desired information on each of a plurality of labels adhered temporarily on a liner sheet of a long shape that constitutes a continuous paper while unwinding a rolled continuous paper (print medium) to feed along a feed path (medium feed path) in a sheet-shape.

In the label printer, there is installed a paper sheet supply unit (medium supply unit), which supplies the continuous paper, a supporting stand, which has a platen roller feeding the continuous paper supplied from the paper sheet supply unit along the feed path, and a printing unit, which has a thermal head (printing head) printing the desired information on the label of the continuous paper.

Here, examples of the printer installed with the thermal head include: a thermal transfer printer, which prints predetermined information by nipping an ink ribbon and the continuous paper with the thermal head and the platen roller to melt the ink of the ink ribbon with a heat generated by the thermal head, and transfer and fix the melted ink on a printing paper sheet; and a thermal printer, which prints predetermined information not via the ink ribbon but by providing the heat of the thermal head directly on a thermosensitive continuous paper.

When the continuous paper is supplied in the thermal transfer printer, a printing failure, such as a lack of printing, may be caused if the continuous paper with dust powders adhered is supplied to an inside of the printer, and the printing operation using the ink ribbon is performed on the continuous paper with the dust powders adhered.

On the other hand, as for the thermal printer, which does not use the ink ribbon, dust powders may be deposited in the proximity of heating body of the thermal head to cause a printing failure and a short service life of the thermal head.

Therefore, it is necessary to remove the adhered dust powders by opening the printing unit to expose the thermal head to clean the thermal head periodically.

When no improvement of the printing failure is observed even after the thermal head cleaning, the thermal head may have reached its service life. In this case, it is necessary to replace the thermal head with the new one.

It should be noted that JP2007-301869A, for example, discloses a printer that has such a label printing function.

SUMMARY OF INVENTION

However, since the thermal head is approximately horizontal in a state where the printing unit is closed, an orientation of the thermal head bends downward (in other words, the heating resistors disposed in the thermal head face down) when the printing unit is opened for maintenance such as cleaning and replacing of the thermal head.

Therefore, an operator was required to perform the maintenance by looking up the thermal head from below, which leads to the degraded work efficiency.

The present invention has been made in view of the above-described technical background, and it is an object of the present invention to provide a printer in which the orientation of the printing head bending downward when the printing unit is in the open position can be relaxed.

To solve the above-described problem, a printer according to a first aspect of the present invention includes a medium supply unit configured to supply a print medium, a platen roller configured to feed the print medium supplied from the medium supply unit along a medium feed path, a printing unit that includes a printing head mounting portion to which a printing head is mounted, the printing head being configured to print on the print medium in a position opposing to the platen roller, the printing head mounting portion being configured to allow the printing head to open/close in a contact/separate direction with respect to the platen roller by the printing head mounting portion swinging with a pivot shaft, and a displacement member configured to swing in conjunction with opening and closing of the printing unit, in an open position of the printing unit, the displacement member being configured to displace an upstream side end portion of the printing head at an upstream side in a feed direction of the print medium to a separating direction from the printing head mounting portion.

A printer according to a second aspect of the present invention, in the printer according to the above-described first aspect, the printing unit includes a downstream side end portion of the printing head at a downstream side in the feed direction of the print medium, and the upstream side end portion of the printing head at the upstream side in the feed direction of the print medium, the downstream side end portion is swingably installed to the printing head mounting portion, and the upstream side end portion is swingably installed to the displacement member.

A printer according to a third aspect of the present invention, in the printer according to the above-described first or second aspect, further includes a first restricting member that abuts on the displacement member in a closed position of the printing unit, the first restricting member restricting heating resistors of the printing head to be in orientation opposing to the platen roller via the displacement member, and a second restricting member that abuts on the displacement member in an open position of the printing unit, the second restricting member displacing the upstream side end portion of the printing head at the upstream side in the feed direction of the print medium to a direction separating from the printing head mounting portion via the displacement member.

According to the above-described aspects, in the closed position of the printing unit, since the upstream side end portion of the printing head at the upstream side in the feed direction of the print medium displaces to a direction separating from the printing head mounting portion, orientation of the printing head bending downward improves. This ensures the facilitated maintenance on the printing head.

DESCRIPTION OF EMBODIMENTS

Figure 1:
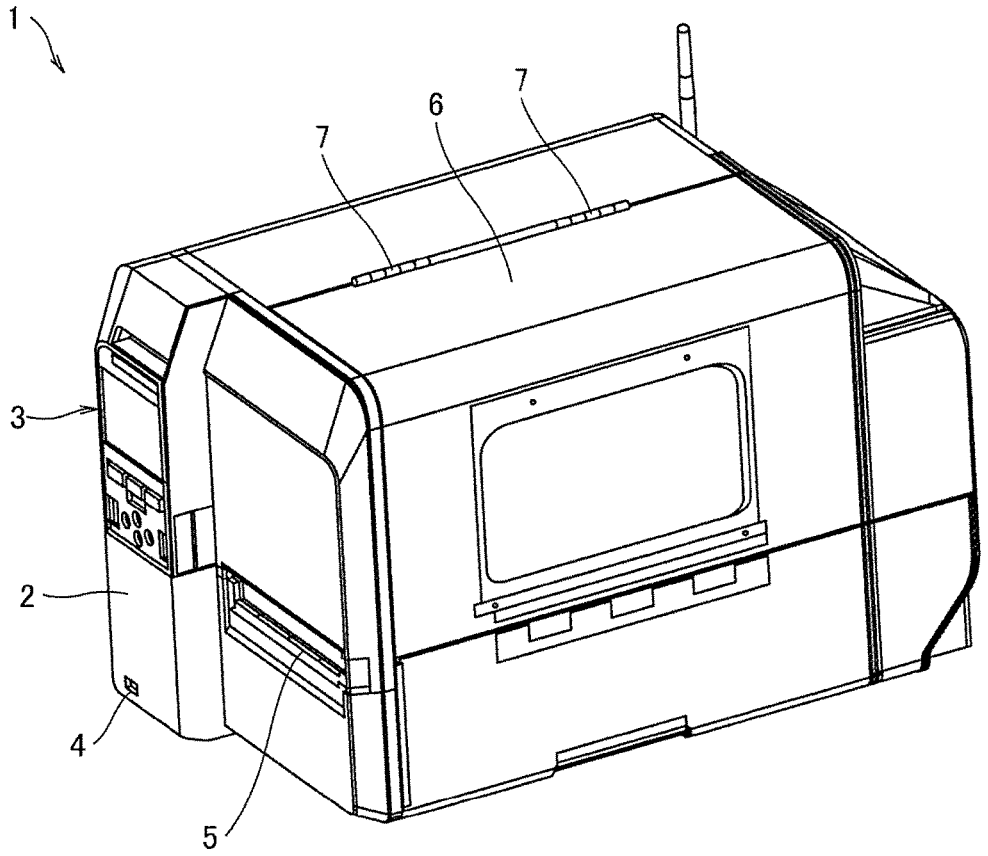
FIG. 1 is an overall perspective view of an appearance of a printer according to one embodiment of the present invention.

The following describes an embodiment as an example of the present invention in detail based on drawings. It should be noted that in the drawings to describe the embodiment, an identical reference numeral is basically attached to an identical component, and its repeated description is omitted.

FIG. 1 is an overall perspective view of an appearance of a printer according to the embodiment.

A printer 1 according to the embodiment has, for example, a label printing function, which prints information such as a character, a sign, a diagram, a barcode, or similar information, on a label adhered temporarily on a liner sheet.

On a front cover portion 2 at a front of the printer 1, an operational panel unit 3, a power switch 4, and an issue port (medium discharge port) 5 are disposed.

On the operational panel unit 3, an LCD (Liquid Crystal Display), which displays a message or similar information, a plurality of keys (line key, feed key, function key, direction indicating key, cancel key, and similar key), which operate an operation of the printer 1, and a plurality of LEDs (Light Emitting Diodes), which indicate a state of the printer 1, are disposed.

On one side surface of the printer 1, an open cover portion 6 is mounted in an openable/closable state in a vertical direction by hinge portions 7 at two sites.

Figure 2:
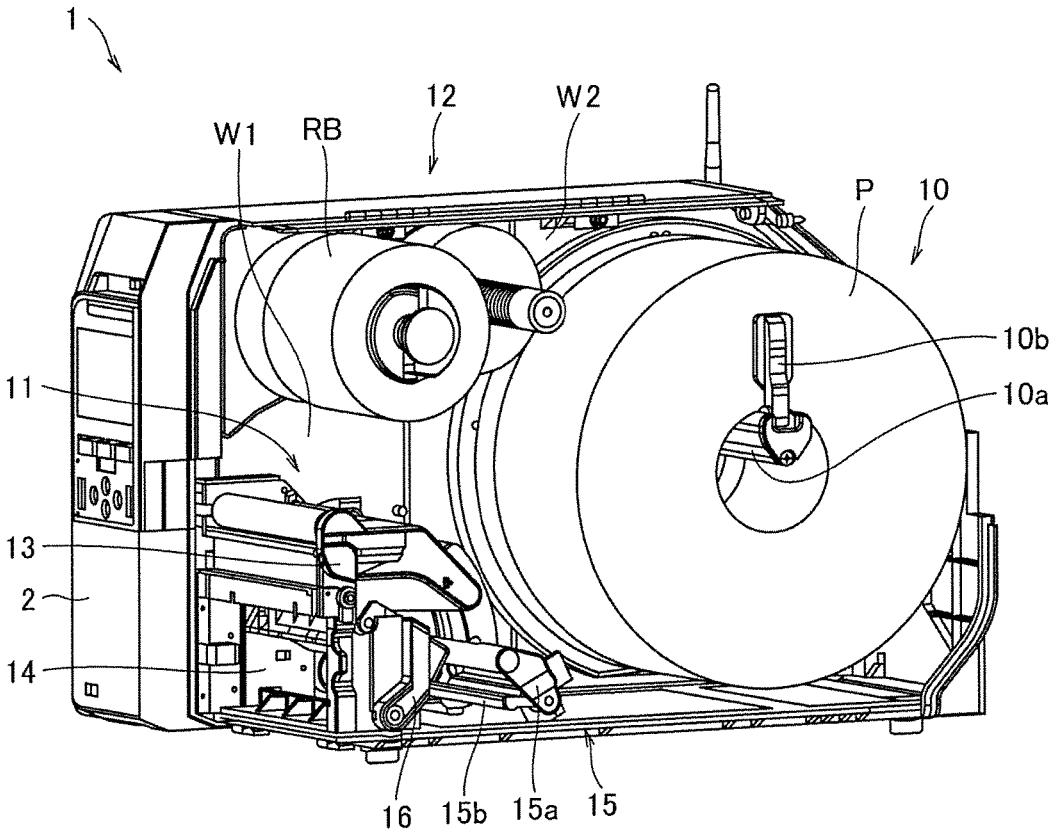
FIG. 2 is a perspective view for illustrating an inside of the printer in FIG. 1.
Figure 3:
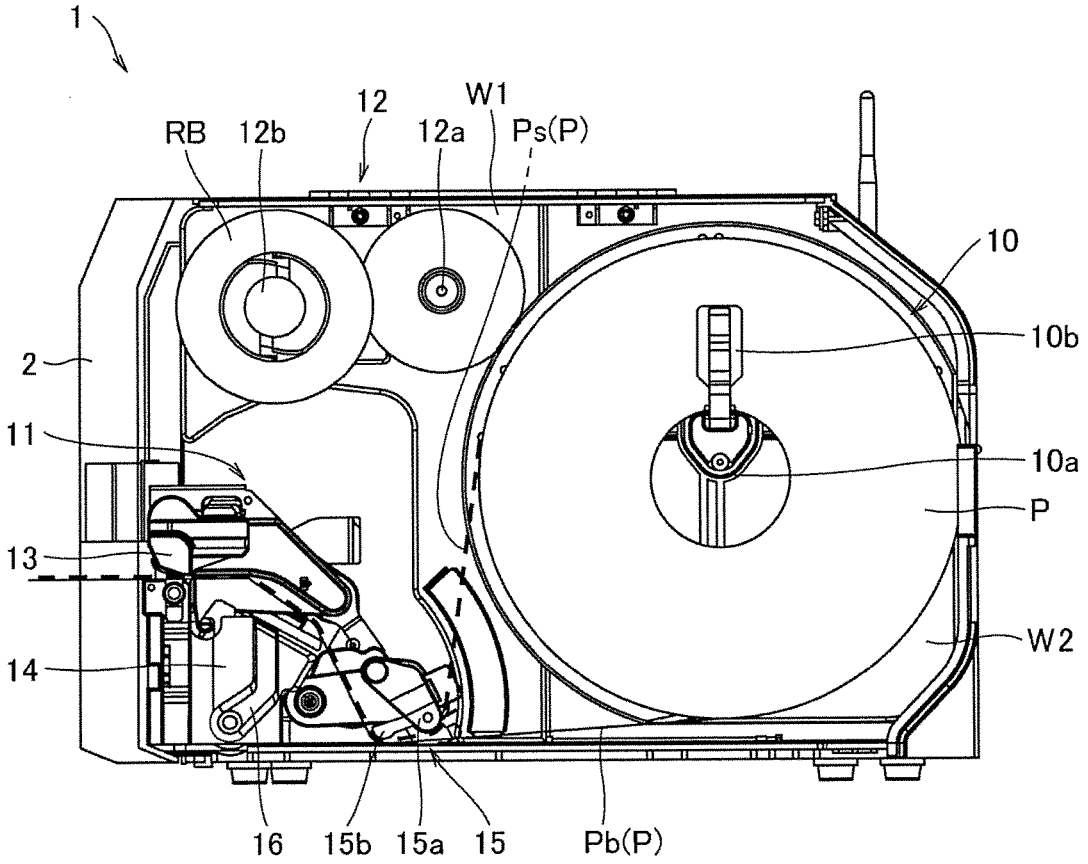
FIG. 3 is a side view of the printer in FIG. 2.
Figure 4:
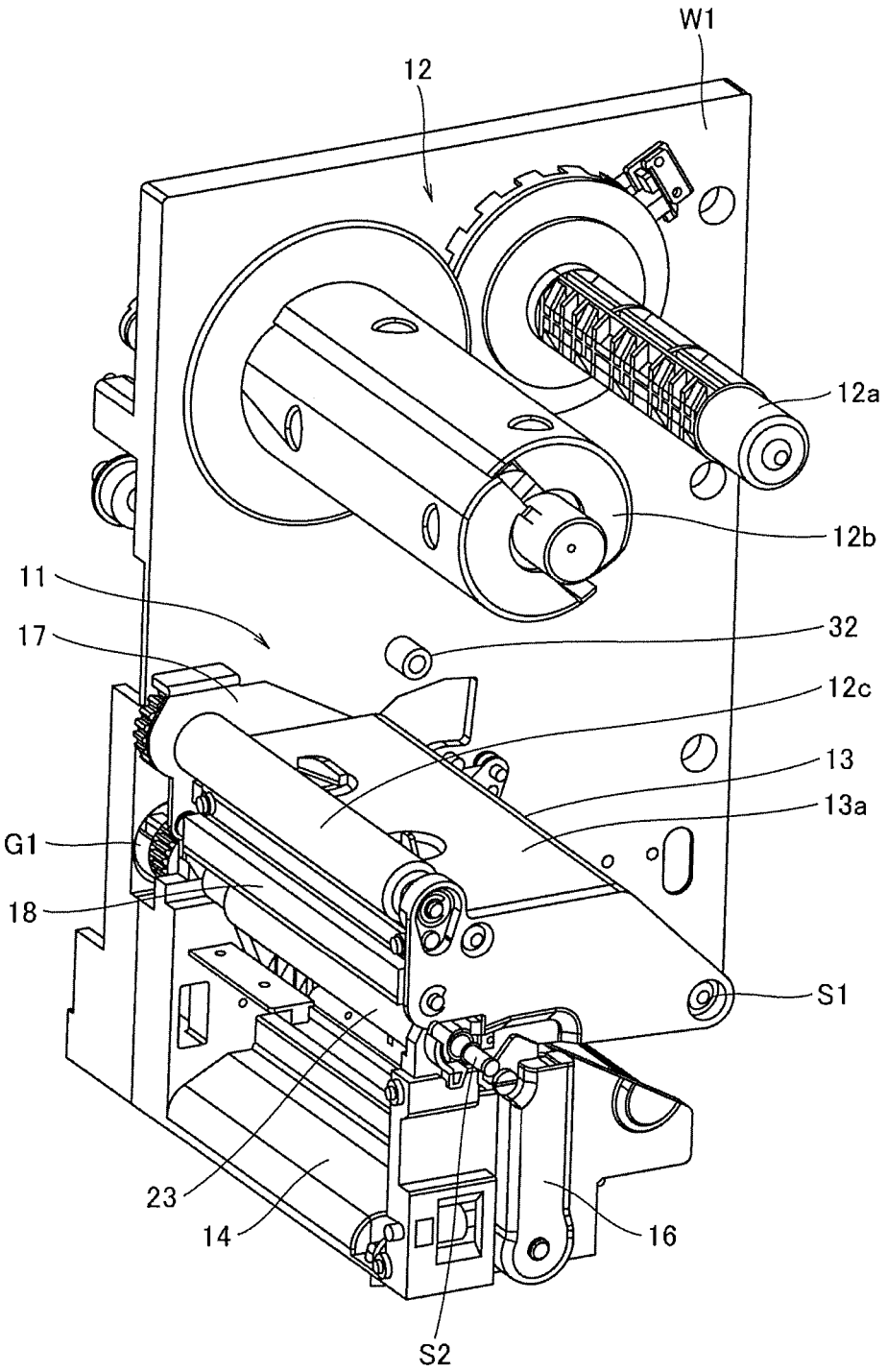
FIG. 4 is a perspective view that extracts and illustrates a print processing portion and an ink ribbon portion of the printer in FIG. 2.

Next, an internal structure of the printer 1 will be described in reference to FIG. 2, FIG. 3 and FIG. 4. FIG. 2 is a perspective view for illustrating an inside of the printer in FIG. 1. FIG. 3 is a side view of the printer in FIG. 2. FIG. 4 is a perspective view that extracts and illustrates a print processing portion and an ink ribbon portion of the printer in FIG. 2. It should be noted that in the following description, a front side of the printer 1 (front cover portion 2 side) is referred to as a front (the downstream side in the feed direction of a continuous paper), and its opposite side, a back side (back cover portion side) is referred to as a rear (the upstream side in the feed direction of the continuous paper).

Inside the printer 1, a paper sheet supply unit (medium supply unit) 10, which is disposed on its rear, a print processing portion 11, which is disposed on its front, and an ink ribbon portion 12, which is disposed on its upper side, are installed.

The paper sheet supply unit 10, which is a configuration unit that supplies a continuous paper (print medium) P to the print processing portion 11, includes a support shaft 10*a* and a roll guiding portion 10*b*, which is installed at one end of the support shaft 10*a*.

The support shaft 10*a* is a configuration portion that rotatably supports the continuous paper P rolled up in a rolled-shape. The roll guiding portion 10*b*, which is a configuration portion that restricts the rolled continuous paper P to meander in a width direction, is movably installed along an axial direction of the support shaft 10*a* to be able to change its position corresponding to a width of the continuous paper P.

The continuous paper P includes, for example, a long liner sheet and a plurality of labels adhered temporarily at every predetermined interval along a longitudinal direction of the liner sheet. On a surface where an adhesive surface of the label contacts on the liner sheet, a releasing agent such as silicone or similar material is coated, and this ensures the label to be peeled off easily. On a surface where the label is not applied on the liner sheet, position detection marks, which indicate a position of the label, are formed at every predetermined interval along the longitudinal direction. About the label, there is a case where a thermal paper is used and a case where a plain paper is used. In the case of the thermal paper, on its surface, a thermal coloring layer, which develops a specific color (such as black or red) when reaching a predetermined temperature region, is formed.

There are two types of continuous papers P: an outside wound label and an inside wound label. The outside wound label is wound in a state where the label of the continuous paper P is positioned on an outer peripheral surface of the rolled continuous paper P, and as shown in FIG. 3, a continuous paper Ps (P: dashed line) is unwound from around the center in the height direction of the paper sheet supply unit 10 toward a bottom portion of the print processing portion 11.

In contrast, the inside wound label is wound in a state where the label of the continuous paper P is positioned on an inner peripheral surface side of the rolled continuous paper P, and as shown in FIG. 3, a continuous paper Pb (P: solid line) is unwound from around an internal bottom surface of the printer 1 toward the bottom portion of the print processing portion 11.

It should be noted that for both outside wound and inside wound, paper passing routes of the continuous paper P (Ps, Pb) in the print processing portion 11 are identical. For both outside wound label and inside wound label, the continuous paper P is fed in a state where a surface where the label is temporarily adhered (printed surface) is upward.

The above-described print processing portion 11, which is a configuration portion that prints on the label of continuous paper P or a similar print medium, includes a printing unit 13, a supporting stand 14, which is disposed below the printing unit 13, and a damper portion 15, which is disposed on a rear (the upstream of feed of the continuous paper P at a printing process) of them.

The printing unit 13 is, as described below, installed inside the printer 1 in an openable/closable state with respect to the supporting stand 14. When the printing unit 13 is in a closed state, between the printing unit 13 and the supporting stand 14, the paper passing route (medium feed path) is formed. Then, this paper passing route is coupled to the above-described issue port 5 (see FIG. 1).

On the supporting stand 14, a head lock lever portion 16, which maintains the closed state of the printing unit 13, is installed. Operating this head lock lever portion 16 releases the closed state of the printing unit 13, and then a front portion of the printing unit 13 is lifted to open the printing unit 13 (the printing unit 13 separates from a platen roller 23).

The damper portion 15 is a configuration portion that gives tension to the continuous paper P. According to the embodiment, the damper portion 15, which includes an outer damper portion 15*a* and an inner damper portion 15*b*, moves in the vertical direction (opens and closes) in conjunction with an opening and closing of the printing unit 13. However, in the closed state of the printing unit 13, the outer damper portion 15*a* and the inner damper portion 15*b* are swingably installed such that each can give tension to the continuous paper P.

The above-described ink ribbon portion 12, which is a configuration portion that supplies and rolls up an ink ribbon where printing ink is applied, includes a ribbon supply unit 12*a* and a ribbon roll up unit 12*b*, which is disposed on a lateral of a front of the ribbon supply unit 12*a*. The ribbon supply unit 12*a* is a configuration unit that rotatably supports the ink ribbon rolled up in a rolled-shape. The ribbon roll up unit 12*b* is a configuration unit that rolls up and recovers an already printed ink ribbon RB. It should be noted that when using the ink ribbon, the ink ribbon extracted from the ribbon supply unit 12*a* is passed through below the printing unit 13, and then rolled up by the ribbon roll up unit 12*b* via a ribbon relay roller 12*c*.

The print processing portion 11 and the ink ribbon portion 12 is mounted on a front side partition wall W1 that is installed along the hinge portion 7 (see FIG. 4), and the paper sheet supply unit 10 is also installed along the hinge portion 7 and mounted on a rear side partition wall W2 that is arranged in series with respect to the front side partition wall W1.

According to such printer 1, the continuous paper P (Ps, Pb), which is unwound from the paper sheet supply unit 10 in a sheet-shape, is fed to the paper passing route between the printing unit 13 and the supporting stand 14 via the damper portion 15, and in the middle of this, a printing processing is executed on the label of the continuous paper P or a similar print medium. After that, the continuous paper P is discharged outside the printer 1 from the issue port 5.

Figure 5A:
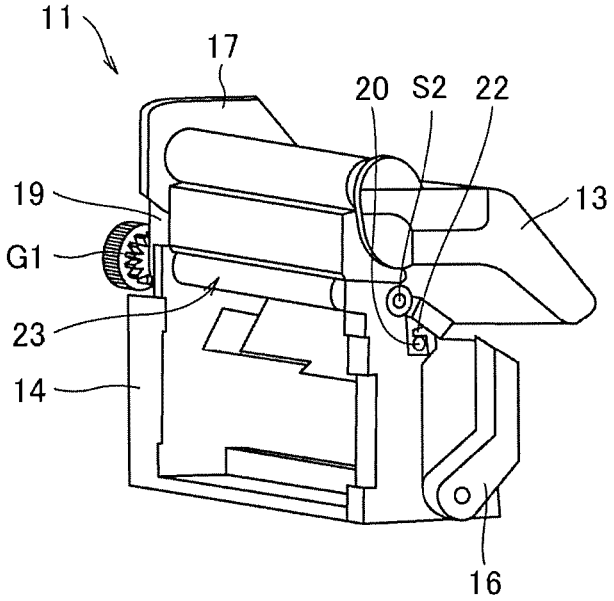
FIG. 5A is an enlarged perspective view where a printing unit in a closed state of a printing unit in FIG. 3 is viewed from a front.
Figure 5B:
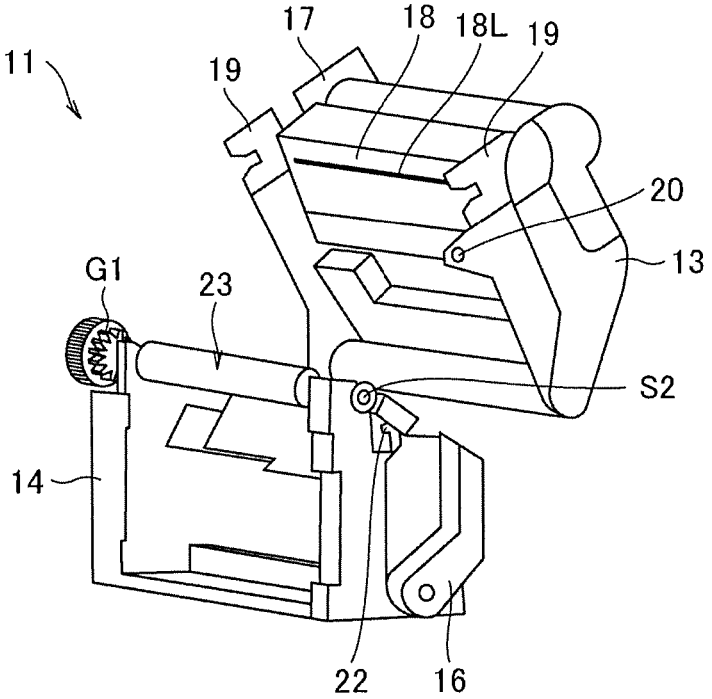
FIG. 5B is an enlarged perspective view where the printing unit in an open state of the printing unit in FIG. 3 is viewed from a front.

Next, a configuration of the above-described print processing portion 11 will be described with reference to FIG. 4, FIG. 5A, and FIG. 5B. FIG. 5A is a schematic perspective view where a printing unit in a closed state of a printing unit in FIG. 3 is viewed from a front. FIG. 5B is a schematic perspective view where the printing unit in an open state of the printing unit in FIG. 3 is viewed from a front.

The printing unit 13 includes a thermal head (printing head) 18 that prints on the continuous paper P in a position opposing to the platen roller 23 that is rotatably mounted on the supporting stand 14. This thermal head 18 is mounted on a bracket (printing head mounting portion) 13*a*. The thermal head 18 is openable/closable in a vertical direction with respect to the supporting stand 14 by swinging the front portion of the bracket 13*a* using a pivot shaft S1 which is disposed in the rear as a fulcrum, and is supported by a head support plate 17 in one side surface of the printing unit 13.

The inferior surface of the printing unit 13 (a surface facing the paper passing route) is installed with the aforementioned thermal head 18 with its printing surface facing the paper passing route. The thermal head 18 is a printing head that prints on the label of the continuous paper P and similar print medium with heating resistors of a printing line 18L disposed on a printing surface of the thermal head 18 (see FIG. 9). On this printing line 18L, a plurality of heating resistors (heating elements), which generates heat by energization, are arranged along a width direction of the continuous paper P (a direction perpendicular to the feed direction of the continuous paper P).

On an inferior surface of a front side of the printing unit 13, depressed claw portions 19, 19 (see FIG. 5B) are disposed so as to sandwich the thermal head 18. On the inferior surface of the printing unit 13, pins 20, 20, which project outward from both side surfaces of the printing unit 13, are disposed on a rear of the depressed claw portion 19.

While such printing unit 13 is biased in the opening direction by a torsion spring (not illustrated) mounted on the pivot shaft S1 (see FIG. 4), the printing unit 13 is maintained to be in the closed state with lock claw portions 22, 22 of the supporting stand 14 being hooked in the pins 20, 20 on a lower portion of the printing unit 13. Pushing the above-described head lock lever portion 16 rearward moves the lock claw portion 22 rearward along with this, thus unhooking the lock claw portion 22 from the pin 20. Unhooking the lock claw portion 22 from the pin 20, as shown in FIG. 5B, automatically opens the printing unit 13 by biasing force of the torsion spring.

In the closed state of the printing unit 13, the printing surface of the thermal head 18 is pressed on the platen roller 23 below, and the depressed claw portions 19,19 of the printing unit 13 engage with both end portion of a rotary shaft S2 of the platen roller 23 (see FIG. 5A and FIG. 5B).

The platen roller 23 is a feeding means to feed the continuous paper P unwound from the paper sheet supply unit 10 to the issue port 5 in the front (see FIG. 1) along the paper passing route, and its surface is coated with an elastic material such as a hard rubber. This platen roller 23 is installed on the upper portion of the supporting stand 14 rotatably in normal and reverse directions. To one end in an axial direction of the rotary shaft S2 of the platen roller 23, a gear G1 is coupled. This gear G1, for example, is engaged with a rotary shaft of a driver (not illustrated) such as a stepping motor via such as a timing belt (not illustrated).

According to such print processing portion 11, at the printing process, the continuous paper P is fed in a state where a predetermined tension is given by the damper portion 15 by rotating the platen roller 23 in a state where the continuous paper P is nipped between the thermal head 18 and the platen roller 23. Then, based on information detected by the paper-sheet-position detecting sensor (not illustrated), a printing timing is determined, and the heating resistors of the printing line 18L are selectively heated by a printing signal transmitted to the thermal head 18. Thus, desired information, such as a character, a sign, a diagram, a barcode, or similar information, is printed on the label of the continuous paper P.

Figure 6:
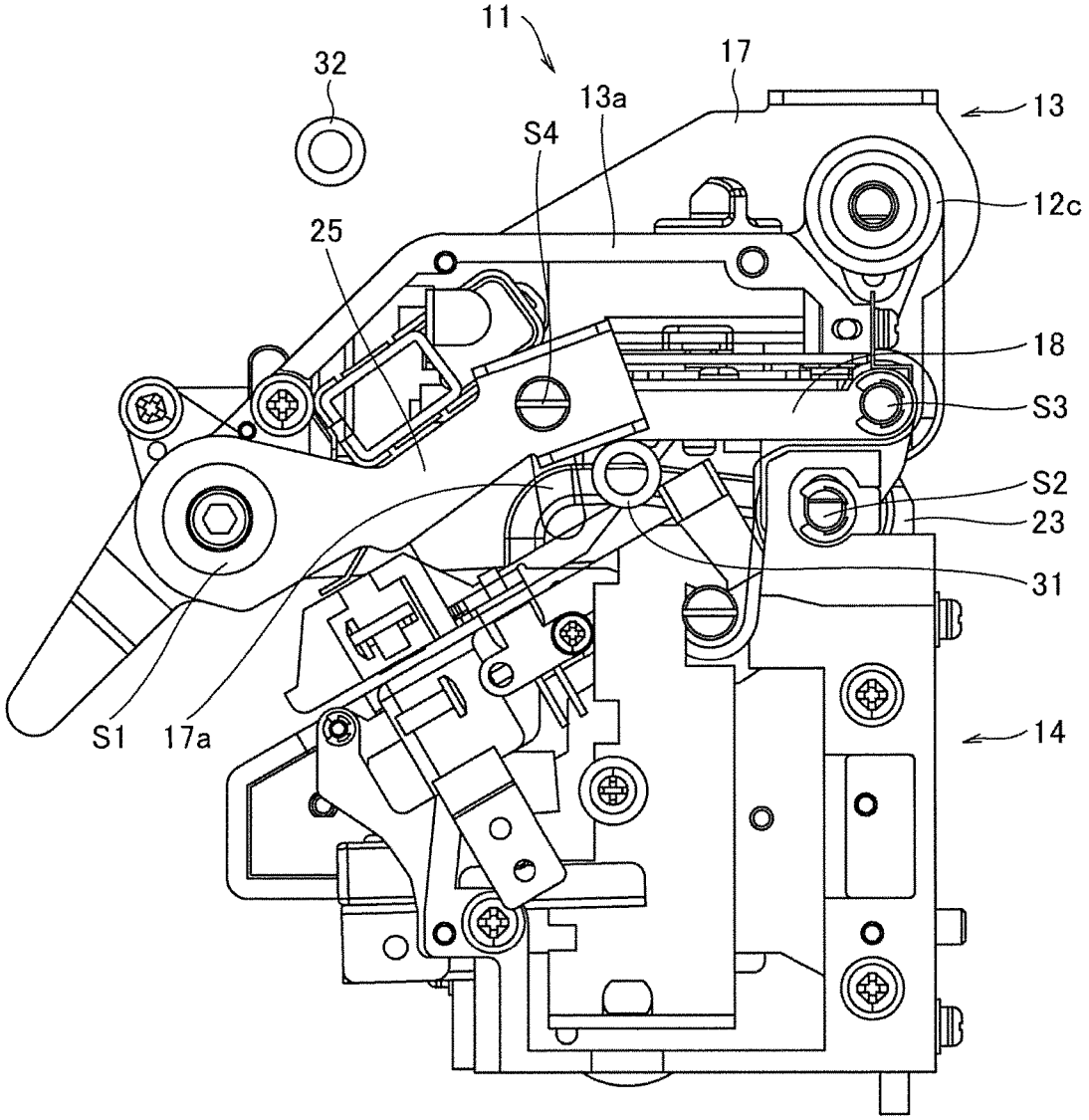
FIG. 6 is a side view of the printing unit in a closed position in the printer of FIG. 1.
Figure 7:
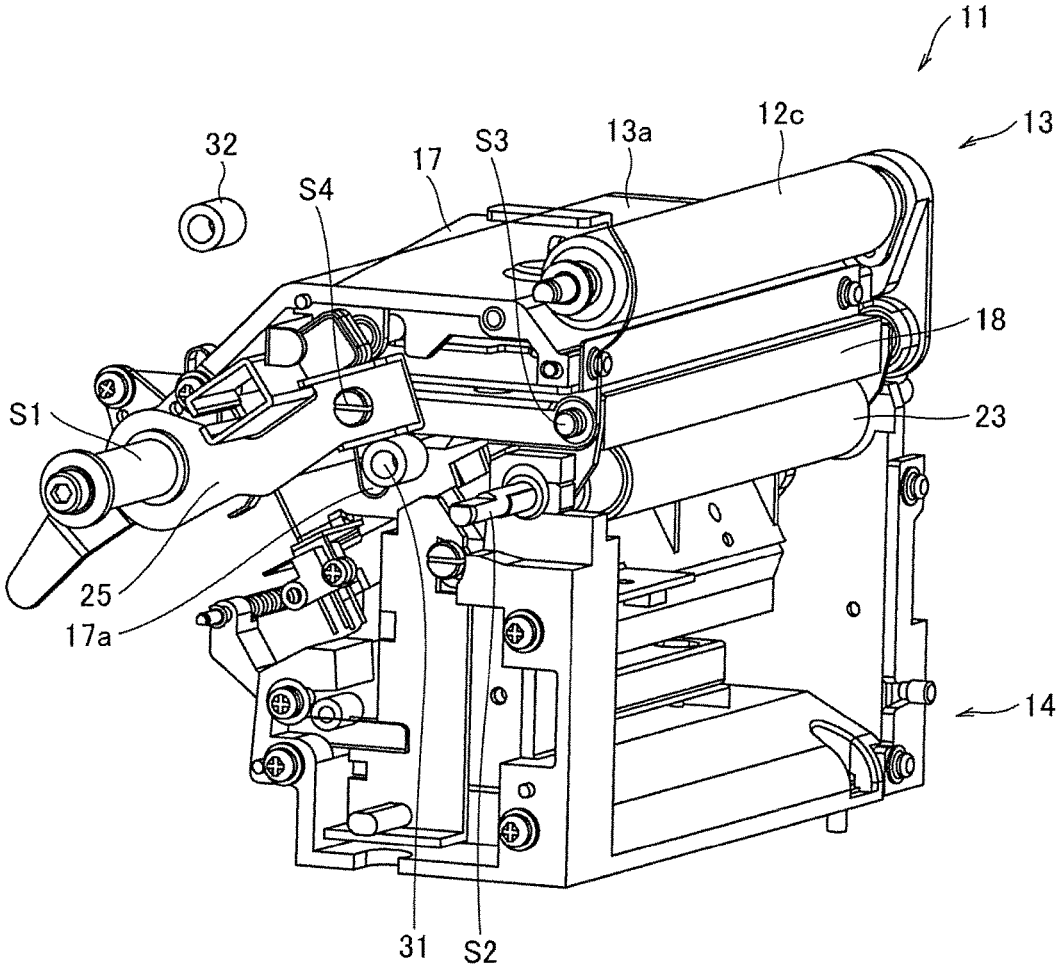
FIG. 7 is a perspective view of the printing unit in the closed position in the printer of FIG. 1.
Figure 8:
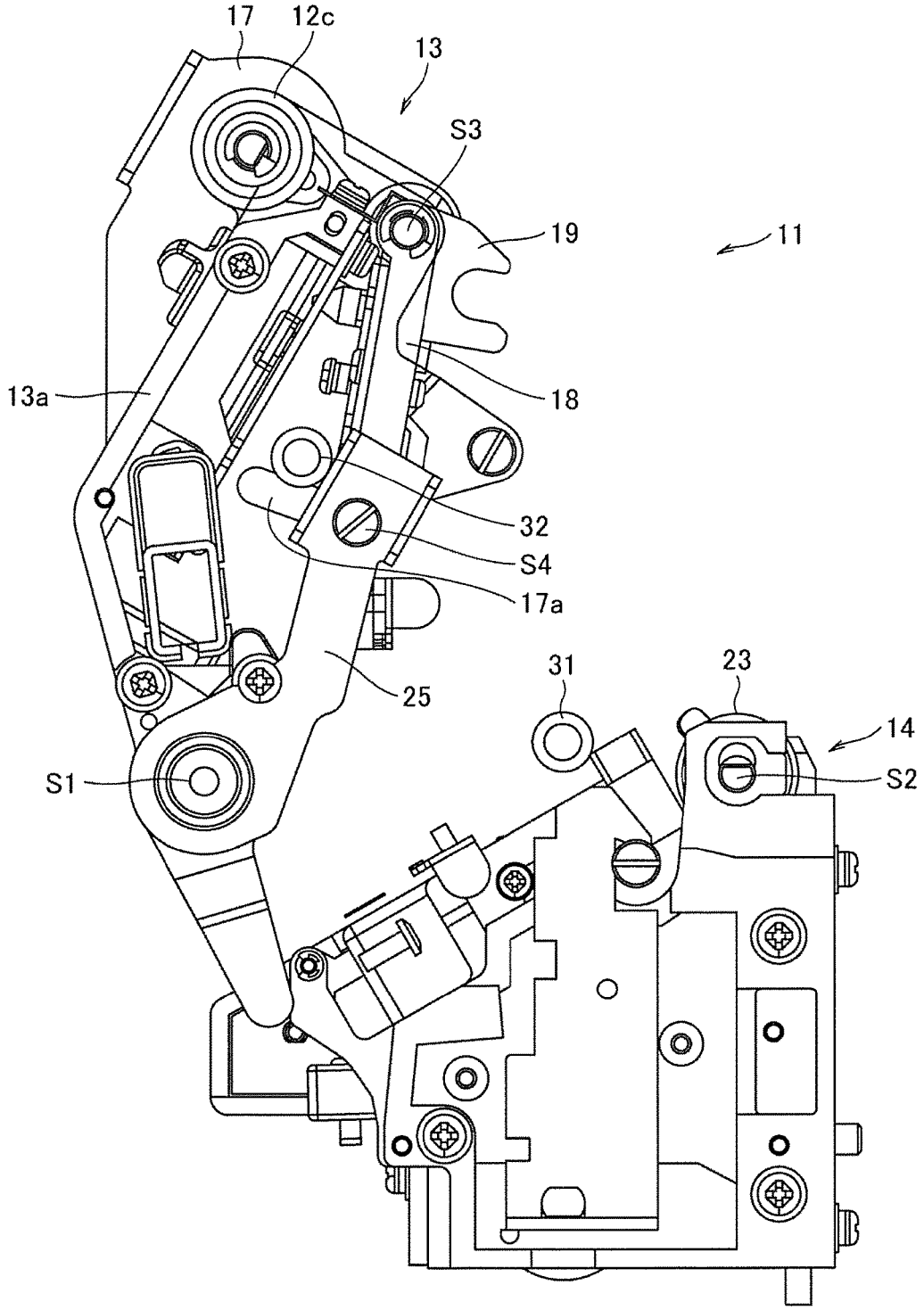
FIG. 8 is a side view of the printing unit in an open position in the printer of FIG. 1.
Figure 9:
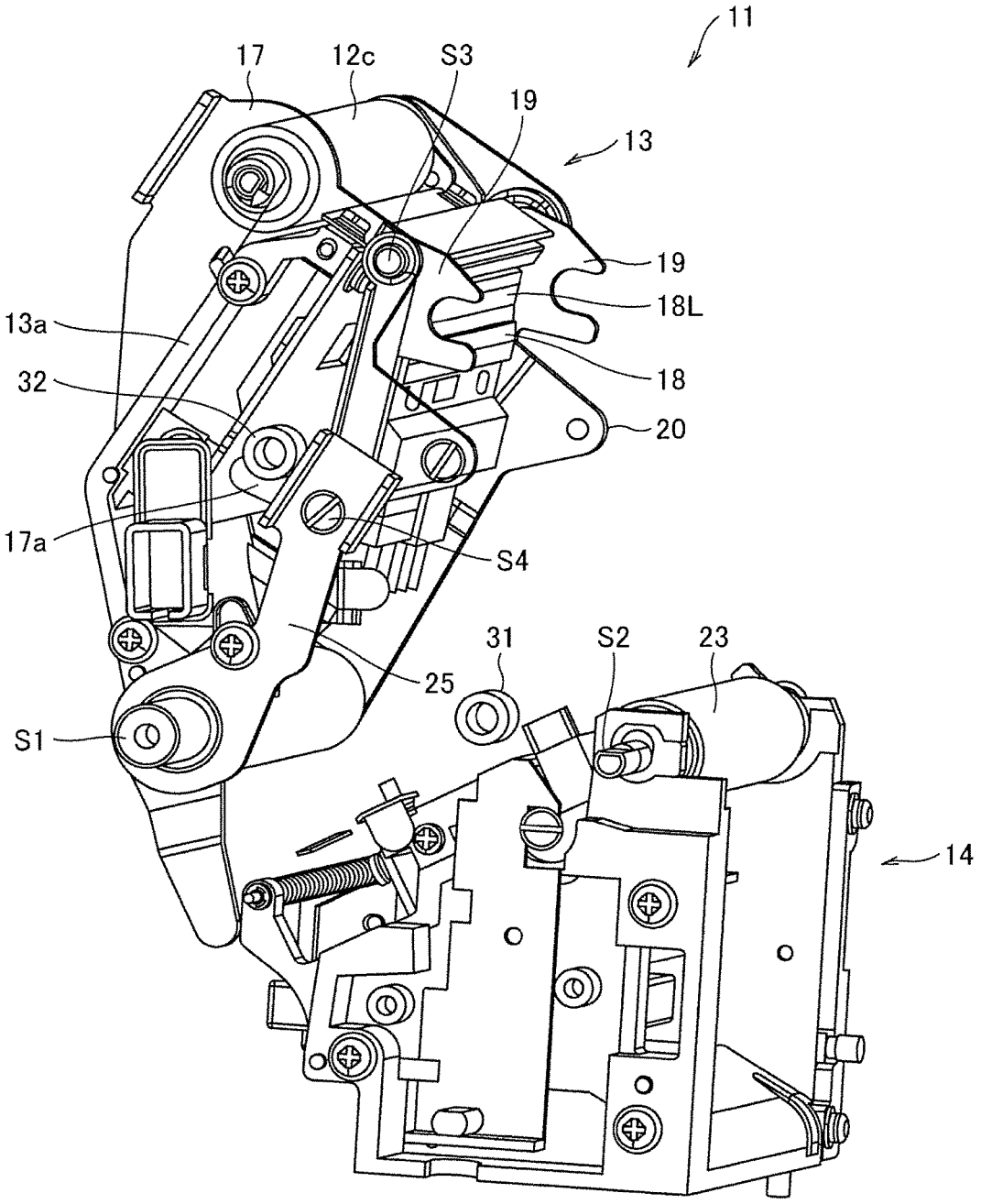
FIG. 9 is a perspective view of the printing unit in the open position in the printer of FIG. 1.

Next, opening and closing operations of the printing unit 13 will be described with reference to FIG. 6 to FIG. 9. FIG. 6 is a side view of the printing unit in a closed position. FIG. 7 is a perspective view of the printing unit in the closed position. FIG. 8 is a side view of the printing unit in an open position. FIG. 9 is a perspective view of the printing unit in the open position. It should be noted that FIG. 6 to FIG. 9 show through a back surface of the head support plate 17.

As these drawings illustrate, the thermal head 18 disposed in the printing unit 13 is mounted to the bracket 13*a* such that a front of the thermal head 18 (that is, the downstream side end portion of the downstream side in the feed direction of the continuous paper P) can swing freely with a pivot shaft S3 as a fulcrum. The pivot shaft S1, on which the bracket 13*a* is installed, is installed with a support plate (displacement member) 25 that swings with the pivot shaft S1 as the common fulcrum that is a swing fulcrum of the bracket 13*a*. Furthermore, a rear of the aforementioned thermal head 18 (that is, the upstream side end portion of the upstream side with respect to the feed direction of the continuous paper P) is mounted swingably with a pivot shaft S4 that is disposed at the opposite side end of the aforementioned pivot shaft S1 of the support plate 25 (swing fulcrum). Accordingly, the support plate 25 swings in conjunction with the opening and closing operations of the printing unit 13.

As illustrated in FIG. 6 and FIG. 7, when the printing unit 13 is viewed from a side, the thermal head 18 and the support plate 25 are installed to be in a relation to form an angle projecting upward bent at the pivot shaft S4 as a fulcrum when the printing unit 13 is in the closed position. As illustrated in FIG. 8 and FIG. 9, the thermal head 18 and the support plate 25 are installed to be in a relation to form an angle projecting in the opposite direction bent by the swinging pivot shaft S4 as a fulcrum when the printing unit 13 is in the open position.

It should be noted that in order to be able to change the bending state as described above by the support plate 25 swinging with the opening and closing of the printing unit 13, the pivot shaft S4 installed in the support plate 25 is engaged with an engaging hole (not illustrated) formed on the thermal head 18 with a gap formed only enough to change the bending state. In order to permit a move of the pivot shaft S4 when the bending state changes as such, the head support plate 17 has an oblong hole 17*a* formed along a moving trajectory of the pivot shaft S4.

Accordingly, in the closed position of the printing unit 13, the thermal head 18 and the support plate 25 are in the relation to form the angle projecting upward bent at the pivot shaft S4 as a fulcrum, and the printing head is in an orientation to print on the continuous paper P. In the open position of the printing unit 13, the swing of the support plate 25 cause the thermal head 18 and the support plate 25 to swing with the pivot shaft S4 as a fulcrum, and are in the relation to form the angle projecting in the direction opposite to the angle in the closed position.

As illustrated in FIG. 8 and FIG. 9, in the open state where the printing unit 13 is moved to upward, swinging with the pivot shaft S4 as a fulcrum that is generated by such swing of the support plate 25 displaces a lower portion side of the thermal head 18 (a rear portion when the printing unit 13 is in the closed position) to the front.

Here, the aforementioned front side partition wall W1 is disposed with a first restricting member 31 on which the support plate 25 abuts when in the closed position of the printing unit 13, and a second restricting member 32 on which the support plate 25 abuts when in the open position of the printing unit 13.

Accordingly, in the closed position of the printing unit 13, by the support plate 25 abutting on the first restricting member 31, the thermal head 18 is restricted via the support plate 25 to be in an orientation to print on the continuous paper P (an orientation that the printing line 18L as heating resistors opposes to the platen roller 23). In the open position of the printing unit 13, by the support plate 25 abutting on the second restricting member 32, the thermal head 18 is restricted via the support plate 25 to be in an orientation that the lower side of the thermal head 18 is displaced to the front. However, if the orientation of the thermal head 18 can be restricted only by the opening and closing operations of the printing unit 13, the first restricting member 31 and the second restricting member 32 are not required.

According to the printing unit 13 that has the above-mentioned configuration, as illustrated in FIG. 6 and FIG. 7, the support plate 25 abuts on the first restricting member 31, and the thermal head 18 becomes the orientation to print on the continuous paper P. Then, viewing the printing unit 13 from the lateral direction, the thermal head 18 and the support plate 25 are in the relation to form an angle projecting upward bent at the pivot shaft S4 as a fulcrum.

Operating the head lock lever portion 16 (FIG. 2 to FIG. 5) releases the closed state of the printing unit 13 from such closed position, and then, as illustrated in FIG. 8 and FIG. 9, a front portion of the printing unit 13 is lifted by a biasing force of the torsion spring and the printing unit 13 is opened, and the support plate 25 abuts on the second restricting member 32 to be in an open position.

That is, opening operation from the closed position to the open position swings the bracket 13*a* counterclockwise (viewed from the direction illustrated in FIG. 6 and FIG. 8 and the same applies hereafter), and during the swinging process to the open position, an end portion of the support plate 25 abuts on the second restricting member 32, further, the bracket 13*a* swings counterclockwise to push the end portion of the support plate 25 to a front, then the support plate 25 swings clockwise. At this time, the pivot shaft S4 disposed at the end portion of the pushed support plate 25 is pushed out along the oblong hole 17*a*, and the lower portion side of the thermal head 18 supported by the pivot shaft S4 is pushed out and swings counterclockwise.

Thus, the support plate 25 swings in conjunction with the opening operation of the printing unit 13, and then the lower portion side of the thermal head 18 is displaced to the front. That is, the support plate 25 swinging with the pivot shaft S1 and the front of the thermal head 18 swinging with the pivot shaft S3 as a fulcrum make the thermal head 18 and the support plate 25 related to form a reversely bent shape from when in the closed position with the pivot shaft S4 as a fulcrum to displace the lower portion side of the thermal head 18 to the front.

Then, by the lower portion side of the thermal head 18 displacing to the front in the open position of the printing unit 13 in such way, that is, the upstream side end portion of the thermal head 18 at the upstream side in the feed direction of the continuous paper P displacing to a direction separating from the bracket 13*a*, improves the orientation of the thermal head 18 bending downward compared with the case where no displacement is made as illustrated.

Accordingly, when performing maintenance on the thermal head 18 such as a cleaning operation of the thermal head 18 to solve a printing failure and a replacing operation of the thermal head 18 reached its service life, an operator may visually recognize the thermal head 18 approximately from a front without requiring to be in an orientation to look up the thermal head 18 from the lower position. Since this will improve the work efficiency, the maintenance of the thermal head 18 can be performed easier.

It should be noted that the above described that when the printing unit 13 is in the open position, the lower portion side of the thermal head 18 displaces to the front (a direction the pivot shaft S4 separates from the bracket 13*a*) by the thermal head 18 and the support plate 25 being in a relation to form a reversely bent shape from when in the closed position, however, it is enough if the lower portion side of the thermal head 18 displaces to the front when the printing unit 13 is in the open position.

In other words, the relation of the thermal head 18 and the support plate 25 that forms a bent shape is not necessarily reverse from the closed position to the open position of the printing unit 13, and it may be a relation that the thermal head 18 and the support plate 25 to form a straight in the closed position of the printing unit 13 and a relation that both to form a bent shape by the lower portion side of the thermal head 18 displacing to the front in the open position of the printing unit 13. Alternatively, it may be a relation that the thermal head 18 and the support plate 25 to form a bent shape in the closed position of the printing unit 13 and a relation that both to form a straight by the lower portion side of the thermal head 18 displacing to the front in the open position of the printing unit 13.

It should be noted that the bracket 13*a* swings clockwise (viewed from the direction illustrated in FIG. 6 and FIG. 8 and the same applies hereafter) by the closing operation from the open position to the closed position, and during the swinging process to the closed position, the end portion of the support plate 25 abuts on the first restricting member 31, further, the bracket 13*a* swings clockwise to push the end portion of the support plate 25 back to a rear, then the support plate 25 swings counterclockwise. At this time, the pivot shaft S4 disposed at the end portion of the pushed back support plate 25 is pushed back along the oblong hole 17*a*, and the lower portion side of the thermal head 18 supported by the pivot shaft S4 is pushed back and swings clockwise.

In the above, the invention made by the present inventor has been described specifically based on the embodiment. However, it should be understood that the embodiment disclosed herein is for illustrative purposes in all respects, and is not limited to the technique disclosed. That is, the technical scope of the present invention should not be construed in a restrictive manner based on the description in the embodiment, should be construed in accordance with the description in a range of the claim as a principle, and the technique identical to the technique disclosed in a range of the claim and all changes within the scope of the claim are included.

According to the aforementioned embodiment, for example, a case that a continuous paper, which a plurality of labels are adhered temporarily on a liner sheet, is used as a print medium has been described, but this should not be construed in a limiting sense; for example, a continuous label including an adhesive surface on one surface (label without liner sheet), a continuous sheet without an adhesive surface (continuous sheet), or, not limited to papers, a printable film by a thermal head or a similar film can be used as a print medium. The label without liner sheet, the continuous sheet, or the film can include a position detection mark. In the case where the label without liner sheet, where an adhesive exposes, or a similar label is fed, while a non-adhesive coating is applied to a feed path, a roller including silicone can be disposed.

According to the aforementioned embodiment, a case where the present invention is applied to a printer using a printing unit of a front opening type with which the printing unit opens and closes to a front of the printer, is described, however, the present invention is not limited to this, for example, a printer using a printing unit of a side opening type with which the printing unit opens and closes to a side of the printer may be applied with the present invention.

Furthermore, according to the aforementioned embodiment, a thermal transfer printer which uses an ink ribbon is described, however, the present invention may be applied to printers of various configurations such as a thermal printer which does not use the ink ribbon.

In the above description, the present invention has been described in a case applying to a stand-alone type printer, where an input operation to the printer is executed without a personal computer, but this should not be construed in a limiting sense; for example, the present invention may also apply to an on-line type printer, where the input operation to the printer is executed via the personal computer.

This application claims the priority based on Patent Application No. 2013-268259 filed in the Japan Patent Office on Dec. 26, 2013, and every content of this application is incorporated herein by reference.

The invention claimed is:

1. A printer, comprising:

a medium supply unit configured to supply a print medium;

a platen roller configured to feed the print medium supplied from the medium supply unit along a medium feed path; and a printing head mounting portion to which a printing head is mounted, the printing head being configured to print on the print medium in a position opposing to the platen roller, the printing head mounting portion being configured to allow the printing head to open/close in a contact/separate direction with respect to the platen roller by swinging with a pivot shaft, the pivot shaft being disposed in an upstream side in a feed direction of the print medium with respect to the printing head and in parallel with the platen roller, wherein the printing head swings in conjunction with opening and closing of the printing head mounting portion using a downstream side in the feed direction of the print medium as a fulcrum, and in a state where the printing head mounting portion is in an open position, the printing head having orientation where an upstream side in the feed direction of the print medium is displaced to a direction separating from the printing head mounting portion.

2. The printer according to claim 1, further comprising a first restricting member configured to restrict the printing head, in a state where the printing head mounting portion is in a closed position, to have orientation where heating resistors being opposed to the platen roller.

3. The printer according to claim 1, further comprising a second restricting member configured to restrict the printing head, in a state where the printing head mounting portion is in the open position, to have orientation where the upstream side in the feed direction of the print medium being displaced to a direction separating from the printing head mounting portion.

4. The printer according to claim 1, further comprising a displacement member configured to swing in conjunction with opening and closing of the printing head mounting portion, wherein:

a downstream side end portion of the printing head at the downstream side in the feed direction of the print medium is swingably mounted to the printing head mounting portion, and an upstream side end portion of the printing head at the upstream side in the feed direction of the print medium is swingably mounted to the displacement member.

* * * * *